US006179497B1

(12) United States Patent
Hu

(10) Patent No.: US 6,179,497 B1
(45) Date of Patent: Jan. 30, 2001

(54) KEYSWITCH FOR NOTEBOOK COMPUTER

(75) Inventor: Gino Hu, Taipei (TW)

(73) Assignee: Silitek Corporation, Taipei (TW)

( * ) Notice: Under 35 U.S.C. 154(b), the term of this patent shall be extended for 0 days.

(21) Appl. No.: 09/434,302

(22) Filed: Nov. 5, 1999

(51) Int. Cl.[7] ..... B41J 5/16

(52) U.S. Cl. ..... 400/495; 400/490; 200/344

(58) Field of Search ..... 400/495, 492, 400/491.2, 491, 490, 472; 200/344

(56) References Cited

U.S. PATENT DOCUMENTS

| | | | | |
|---|---|---|---|---|
| 5,850,194 | * | 12/1999 | Liu | 341/2 |
| 5,898,145 | * | 4/1999 | Su | 200/344 |
| 5,964,341 | * | 10/1999 | Tsai | 200/344 |
| 5,997,196 | * | 12/1999 | Hu | 400/495 |
| 6,011,227 | * | 1/2000 | Yoneyama | 200/344 |

* cited by examiner

*Primary Examiner*—John S. Hilten
*Assistant Examiner*—Anthony H. Nguyen
(74) *Attorney, Agent, or Firm*—Rosenberg, Klein & Lee

(57) ABSTRACT

A keyswitch for notebook computer comprises at least a keytop, a rubber cone, a base, a bottom plate below the base and two levers arranged in scissors form between the keytop and the base. The upper ends of the two levers are connected to the keytop and the lower ends of the two levers are provided with pivotal shafts. The pivotal shafts on the both lower ends of at least one lever is projecting from an outer wall of the lever such that a dent is formed between a rear wall of the pivotal shaft and a bottom end of the lever. The base has a plurality of through holes corresponding to the pivotal shafts on the both lower ends of the levers and the pivotal shafts are pivotally engaged with the through holes. A clamping plate arranged atop each the through hole. The base has a hollow accommodating space below the two levers. The bottom plate has a plurality of through holes corresponding to the pivotal shafts on the both lower ends of the levers. The dents are fitted to an inner edge of the through holes on the bottom plate. The keyswitch of the present invention has stable movement and is not shaken during operation.

1 Claim, 6 Drawing Sheets

KEYSWITCH FOR NOTEBOOK COMPUTER

FIELD OF THE INVENTION

The present invention relates to a keyswitch for notebook computer, especially to a keyswitch for notebook computer wherein the keytops thereof do not weave during operation.

BACKGROUND OF THE INVENTION

As shown in FIG. 1. the conventional lever type keyswitch 10*a* for notebook computer generally comprises a keytop 11*a*, a rubber cone 12*a*, a first lever 13*a*, a second lever 14*a*, a base 16*a* and a bottom plate 22*a*. The first lever 13*a* and the second lever 14*a* are in scissors arrangement and have respectively pivotal shaft 18*a* and 19*a* on lower end thereof and arranged within a recess 20*a* and 21*a* formed on top of the base 16*a*. Moreover, the upper ends of the first lever 13*a* and the second lever 14*a* are pivotally connected to the bottom of the keytop 11*a* and the rubber cone 12*a* is located to a region corresponding to the key pressing stroke of the keytop 11*a*. The keytop 11*a*, upon key pressing operation, is guide by the first lever 13*a* and the second lever 14*a* to depress the rubber cone 12*a* below the keytop 11*a*. The rubber cone 12*a* is collapsed to touch a circuit membrane 15*a* on the base 16*a*, thus generating keyswitch signal. However in above mentioned conventional lever type keyswitch 10*a*, the keytop 11*a* is liable to shake during the keyswitch operation.

Therefore, it is the object of the present invention to provide a keyswitch, which has stable movement and is not shaken during operation.

To achieve above object, the keyswitch according to the present invention comprises at least a keytop, a rubber cone, a base, a bottom plate below the base and two levers arranged in scissors form between the keytop and the base. The upper ends of the two levers are connected to the keytop and the lower ends of the two levers are provided with pivotal shafts. The pivotal shafts on the both lower ends of at least one lever is projecting from an outer wall of the lever such that a dent is formed between a rear wall of the pivotal shaft and a bottom end of the lever. The base has a plurality of through holes corresponding to the pivotal shafts on the both lower ends of the levers and the pivotal shafts are pivotally engaged with the through holes. A clamping plate arranged atop each the through hole. The base has a hollow accommodating space below the two levers. The bottom plate has a plurality of through holes corresponding to the pivotal shafts on the both lower ends of the levers. The dents are fitted to an inner edge of the through holes on the bottom plate. The keyswitch of the present invention has stable movement and is not shaken during operation.

The various objects and advantages of the present invention will be more readily understood from the following detailed description when read in conjunction with the appended drawing in which:

DETAIL DESCRIPTION OF PREFERRED EMBODIMENT

Figure 1:
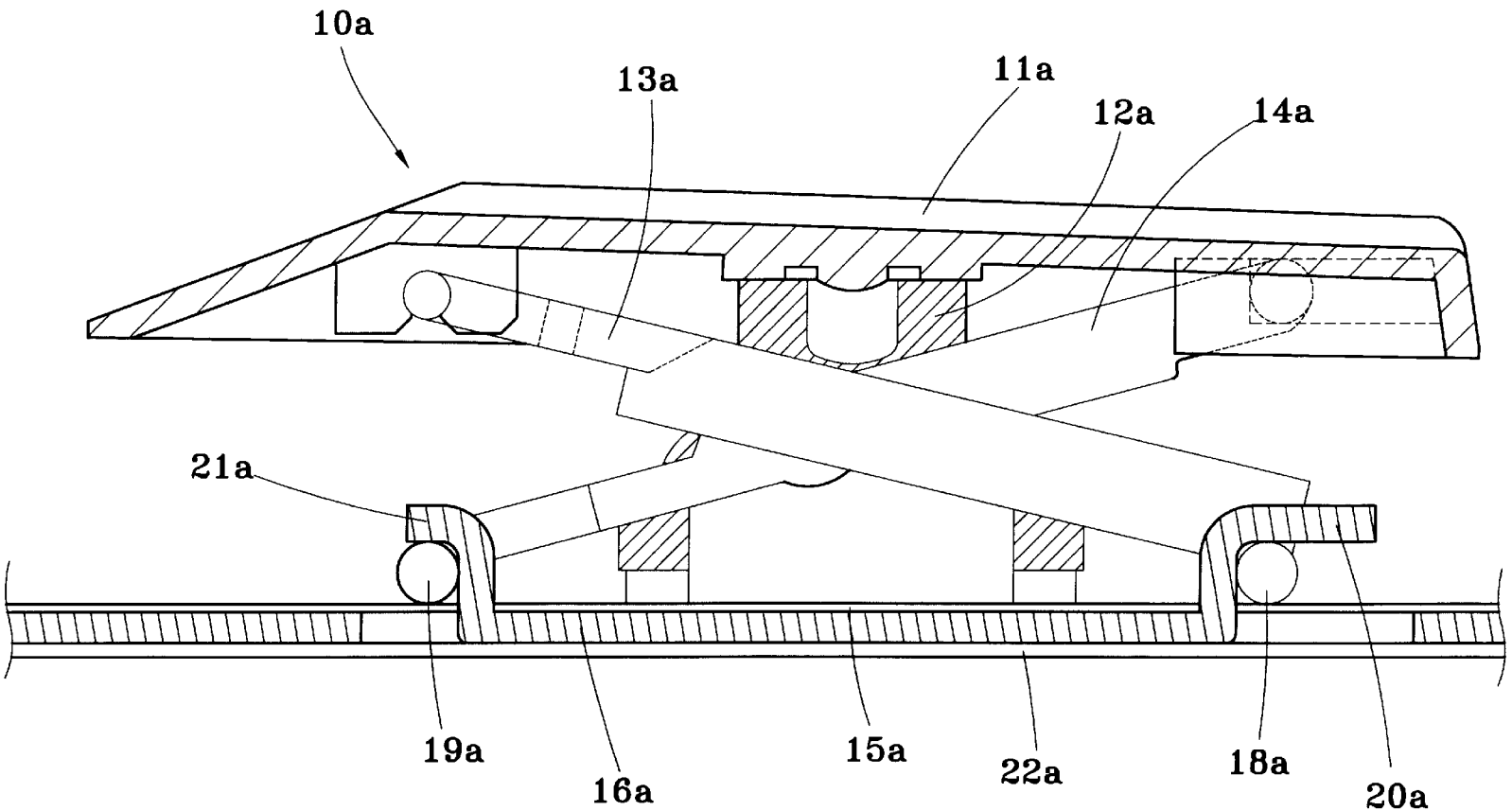
FIG. 1 PRIOR ART
FIG. 1 is the sectional view of a conventional keyswitch.
Figure 2:
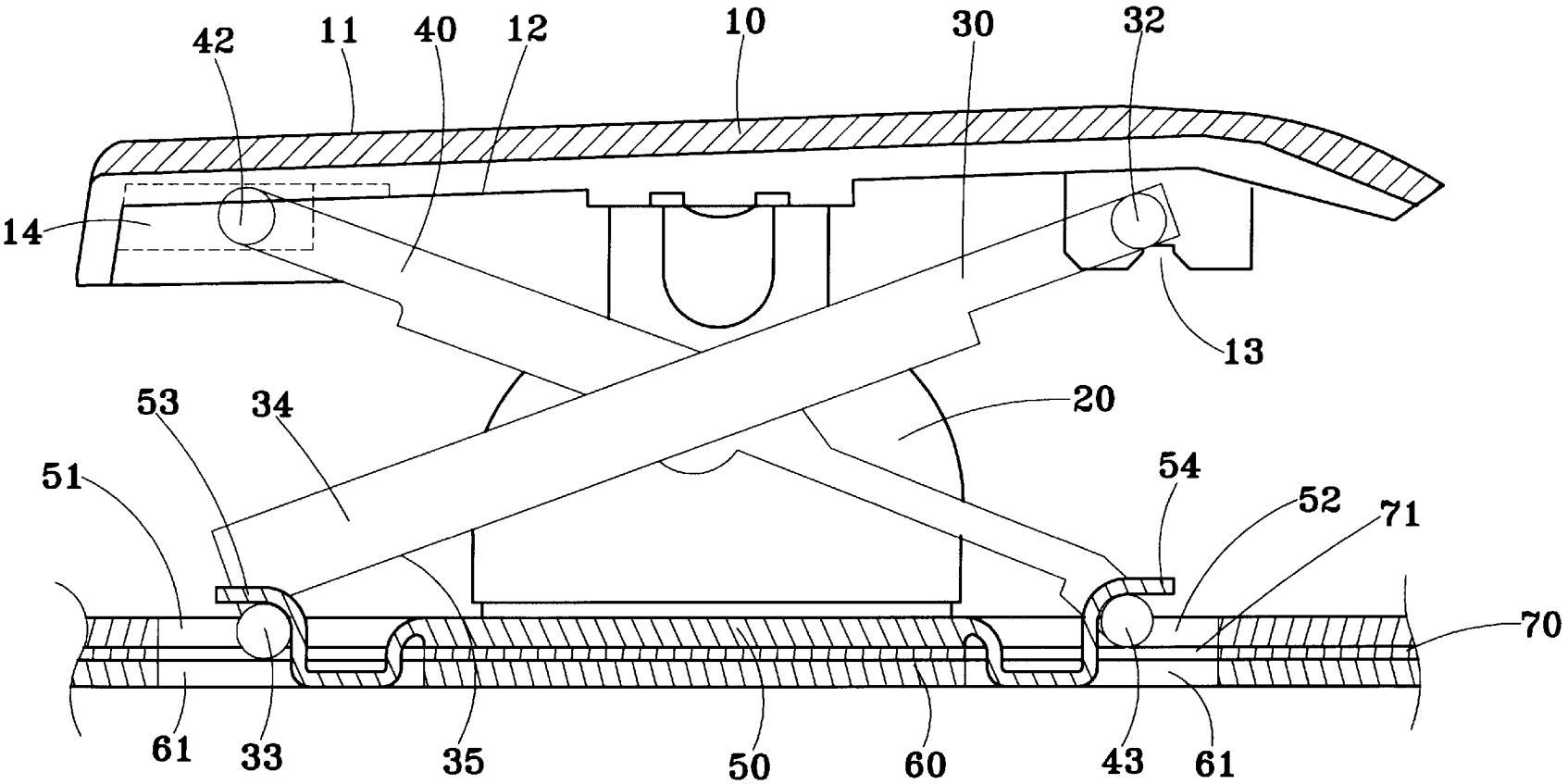
FIG. 2 is the sectional view of the keyswitch according to the present invention.
Figure 3:
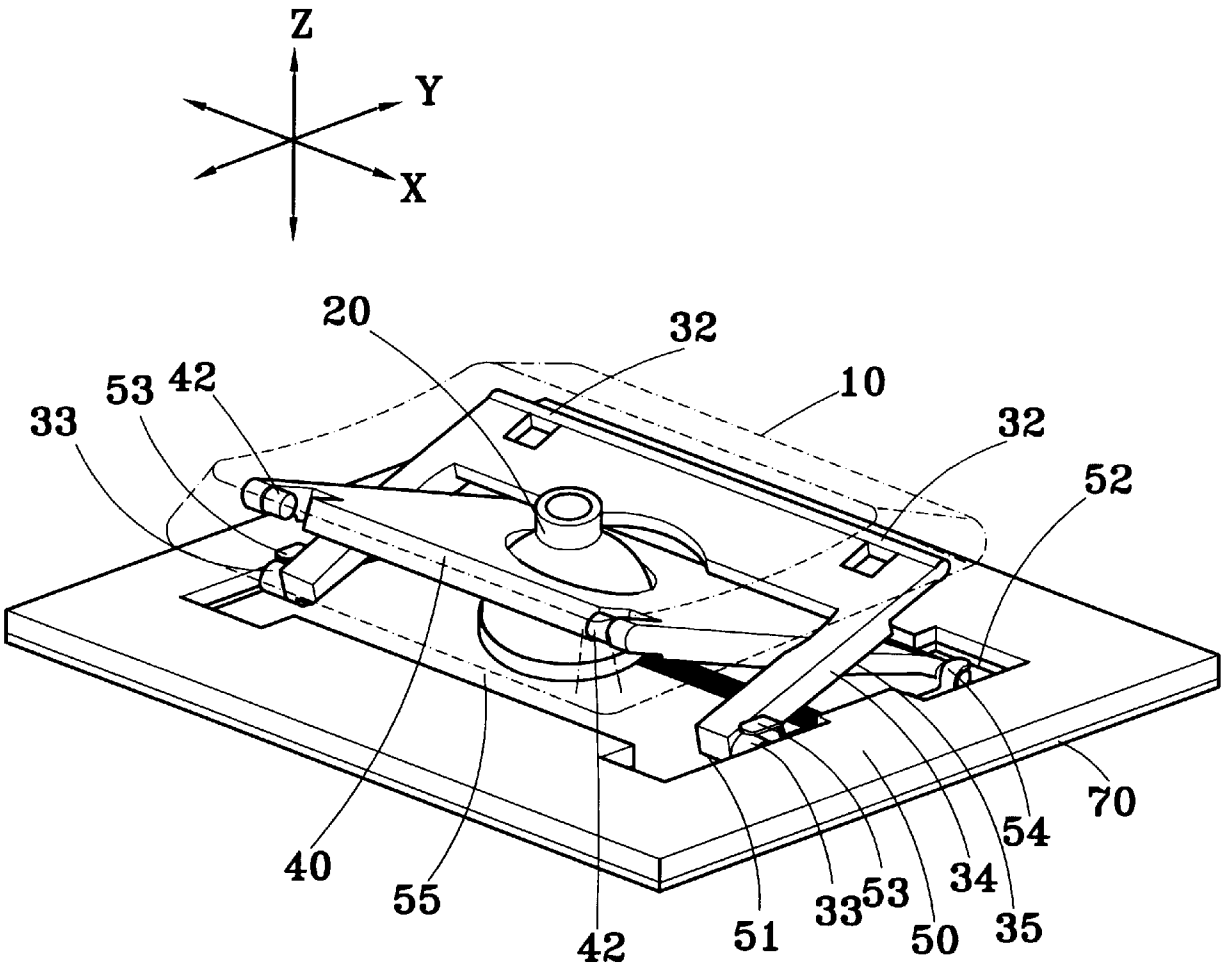
FIG. 3 is the perspective view of the keyswitch according to the present invention
Figure 4:
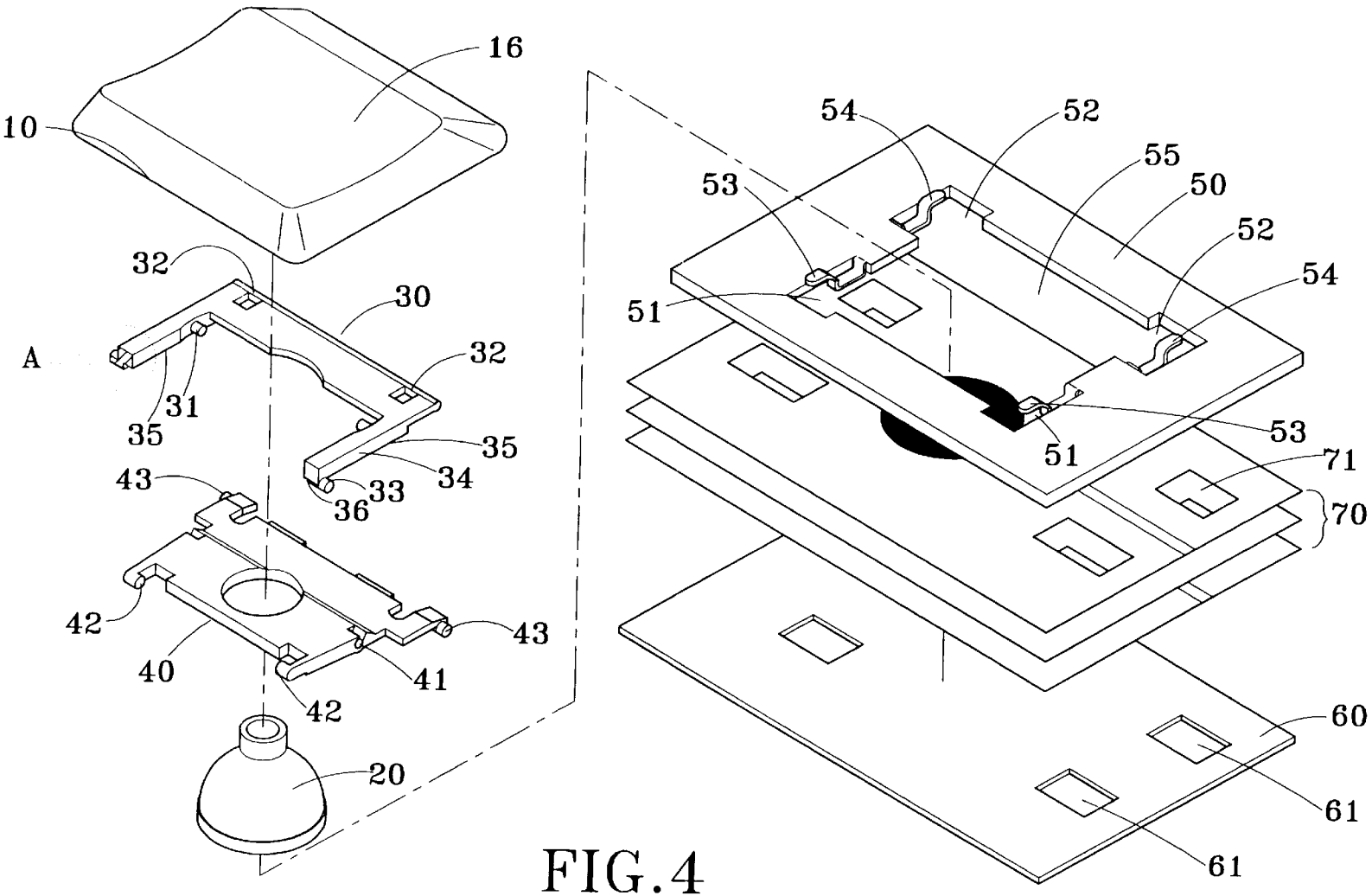
FIG. 4 is the exploded view of the keyswitch according to the present invention.
Figure 4A:
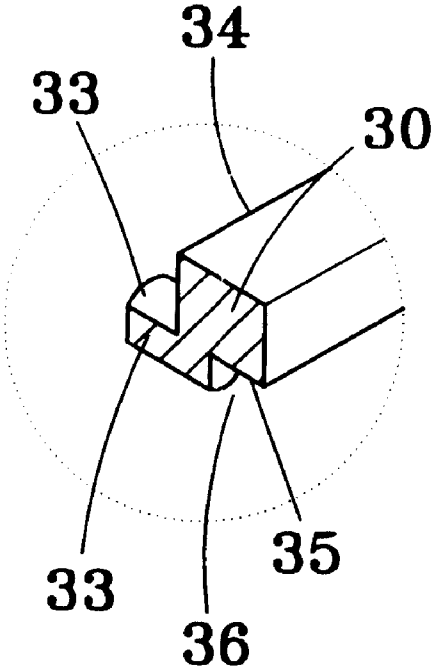
Figure 5:
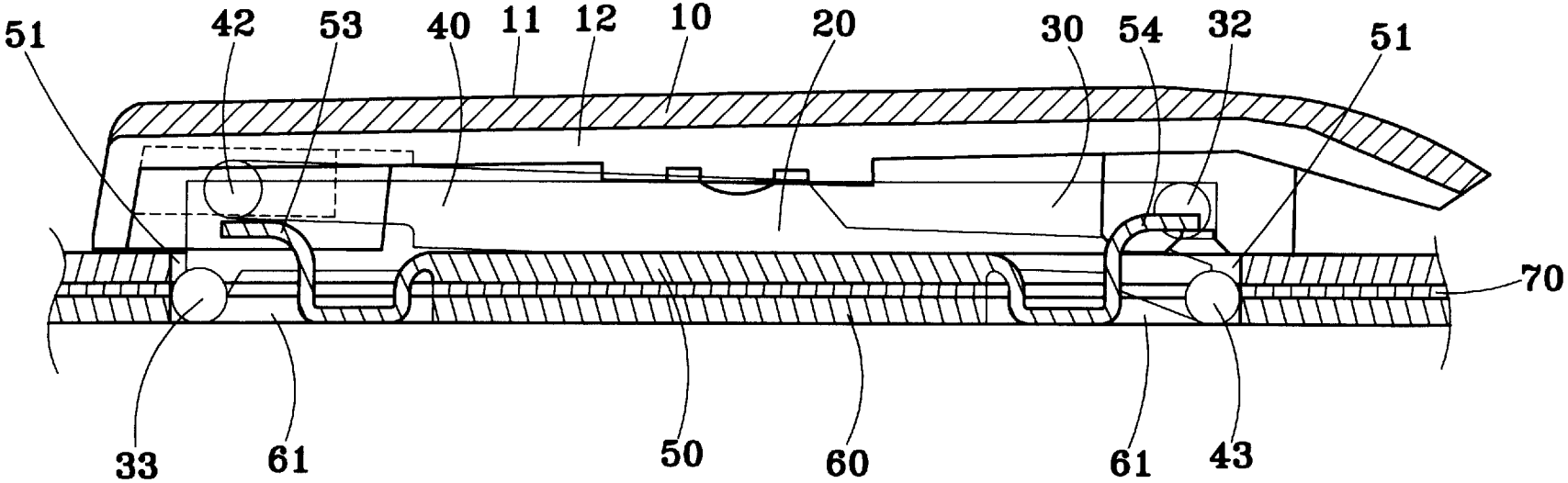
FIG. 5 is the section view of the keyswitch according to the present invention in a pressed state.

With reference now to FIGS. 2, 3, 4 and 5, the present invention is intended to provide a keyswitch for notebook computer wherein the keytops thereof do not weave during operation. As shown in those figures, the keyswitch for notebook computer according to the present invention comprises a keytop 10, a rubber cone 20, a first lever 30, a second lever 40, a base 50 and a bottom plate 60, wherein the keytop 10 is a rectangular cap with an operative surface 11 on top side thereof and an assembling surface 12 on bottom side thereof and having two pivotal holes 13 and two sliding grooves 14.

The rubber cone 20 is placed below the keytop 10 and between the keytop 10 and the base 50. More particularly, the rubber cone 20 is located within a region corresponding to the key pressing stroke of the keytop 10.

The first lever 30 and the second lever 40 are arranged between the assembling surface 12 on bottom side of the keytop 10 and the base 50. The first lever 30 and the second lever 40 have corresponding pivotal poles 31 and pivotal holes 41 on central part thereof such that the first lever 30 and the second lever 40 are arranged in scissors fashion. The first lever 30 has two pivotal shafts 32 on both upper ends thereof and the second lever 40 has two sliding shafts 42 on both upper ends thereof. Therefore, the first lever 30 and the second lever 40 are pivotally and slidably arranged on the assembling surface 12 of the keytop 10 by engaging the pivotal shafts 32 and the sliding shafts 42 with the pivotal holes 13 and sliding grooves 14 of the keytop 10. Moreover the first lever 30 and the second lever 40 have two pivotal shafts 33 and 43 on two bottom ends thereof whereby the first lever 30 and the second lever 40 are pivotally connected to the base 50. In the present invention, at least the two pivotal shafts 33 of the lever 30 project out of the outer wall 34 of the lever 30 such that an L-shaped dent 36 is formed between the bottom wall 35 and the rear wall of the pivotal shaft 33.

The base 50 is arranged below the keytop 10, the first lever 30 and the second lever 40 and has a plurality of through holes 51 and 52 corresponding to the pivotal shafts 33 and 43 of the first lever 30 and the second lever 40. More particularly, the pivotal shafts 33 and 43 of the first lever 30 and the second lever 40 are pivotally engaged to the through holes 51 and 52 on the base 50. The through holes 51 and 52 have respectively retaining plates 53 and 54 to confine the upward displacement of the pivotal shafts 33 and 43 of the first lever 30 and the second lever 40. Moreover, the base 50 has a hollow accommodating space 55 for receiving the first lever 30 and the second lever 40.

The bottom plate 60 is arranged below the base 50 and has a circuit membrane 70 between the bottom plate 60 and the base 50. The circuit membrane 70 and the bottom plate 60 have respectively through holes 71 and 61 corresponding to the pivotal shafts 33 and 43 of the first lever 30 and the second lever 40. The keytop 10, upon key pressing operation, is guide by the first lever 30 and the second lever 40 to depress the rubber cone 22 below the keytop 10. The rubber cone 20 is collapsed to touch the circuit membrane 70 on the base 60, thus generating keyswitch signal. When the keytop 10 together with the first lever 30 and the second lever 40 are pressed downward, the first lever 30 and the second lever 40 are received within the hollow accommodating space 55. Therefore, the thickness of the keytop 10 can be reduced while the key pressing stroke is unchanged. Moreover the provision of the hollow accommodating space

55 allow the first lever 30 and the second lever 40 being assembled from bottom of the keyswitch.

In other word, according to the present invention, the overall height of the keyswitch is reduced because the first lever 30 and the second lever 40 are received within the hollow accommodating space 55 when the keytop 10 is pressed downward. Moreover, the retaining plates 53 can confine the upward displacement of the pivotal shafts 33 and 43 of the first lever 30 and the second lever 40. The dents 36 of the pivotal shafts 33 are fitted to the inner edge of the through holes 61 on the base 60 and slide along the inner edge of the through holes 61. In this way, the downward displacement of the pivotal shafts 33 and 43 of the first lever 30 and the second lever 40 can be confined. Therefore, the first lever 30 has better confinement in up and down (Z axis shown in FIG. 3) direction. Moreover, the outer wall 34 of the first lever 30 is retained by the inner side of the retaining plates 53. The first lever 30 is retained in left and right direction because the dents 36 of the pivotal shafts 33 are fitted to the inner edge of the through holes 61 on the base 60. Therefore the first lever 30 has better confinement in left and right (X axis shown in FIG. 3) direction. Moreover, the pivotal shafts 33 of the first lever 30 are retained in front and rear direction (Y axis shown in FIG. 3) by the retaining plates 53 and the through hole 51.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A keyswitch for notebook computers comprising:

a keytop formed with an operating surface and an assembling surface respectively at a top surface and a lower surface thereof;

a base having a plurality of first through holes formed therein and a centrally disposed second through hole formed in said base, said second through hole intersecting each of said plurality of first through holes, said base having a plurality of retaining plates formed thereon, each of said plurality of retaining plates extending at least partially across a respective one of said first through holes;

a circuit membrane disposed beneath said base, said circuit membrane having a plurality of third through holes formed therein in respective aligned relationship with said plurality of first through holes;

a bottom plate disposed below said circuit membrane and sandwiching said circuit membrane between said bottom plate and said base, said bottom plate having a plurality of fourth through holes formed therein in respective aligned relationship with said plurality of third through holes;

a rubber cone disposed in said second through hole of said base between said assembling surface of said keytop and said circuit membrane; and a first lever and a second lever installed between said assembling surface of said keytop and said base, said first and second levers being pivotally connected together to form a crossed linkage, each of said first and second levers having respective upper ends connected to said assembling surface of said keytop, each of said first and second levers having a pair of lower ends on two respective sides thereof, each said lower end having a pivotal shaft extending laterally from a lower side surface of said lower end with a dent being formed between a rear wall of said pivotal shaft and a portion of said lower side surface adjacent an inner side of said lower end, each of said pivotal shafts being disposed in a respective one of said plurality of first, third and fourth through holes beneath a corresponding one of said plurality of positioning pieces for respective pivotal coupling to said base, each of said dents contacting an inner edge of a respective one of said plurality of fourth through holes to slide along said edge during vertical displacement of said keytop and thereby laterally confine said first and second levers during said displacement, said first and second levers being received into said second through hole of said base responsive to downward displacement of said keytop.

* * * * *